US008413686B2

(12) United States Patent
Ko

(10) Patent No.: US 8,413,686 B2
(45) Date of Patent: Apr. 9, 2013

(54) FAUCET WITH RETRACTABLE SPOUT THAT CAN BE POSITIONED QUICKLY AND AUTOMATICALLY

(75) Inventor: Jui-Feng Ko, Changhua County (TW)

(73) Assignee: Chung Cheng Faucet Co., Ltd., Changhua County (TW)

( * ) Notice: Subject to any disclaimer, the term of this patent is extended or adjusted under 35 U.S.C. 154(b) by 256 days.

(21) Appl. No.: 12/861,073

(22) Filed: Aug. 23, 2010

(65) Prior Publication Data

US 2012/0042973 A1 Feb. 23, 2012

(51) Int. Cl.
*B05B 7/02* (2006.01)

(52) U.S. Cl.
USPC ..... 137/801; 239/588; 239/526; 239/530

(58) Field of Classification Search ..... 137/801; 239/587.1, 588, 525, 530, 531
See application file for complete search history.

(56) References Cited

U.S. PATENT DOCUMENTS

| | | | | |
|---|---|---|---|---|
| 3,181,895 | A * | 5/1965 | Cator | 285/1 |
| 6,588,453 | B2 * | 7/2003 | Marty et al. | 137/801 |
| 6,810,539 | B2 * | 11/2004 | Bosio | 4/678 |
| 2006/0283511 | A1 * | 12/2006 | Nelson | 137/801 |
| 2008/0067264 | A1 * | 3/2008 | Erickson et al. | 239/445 |

* cited by examiner

*Primary Examiner* — John Rivell
*Assistant Examiner* — Angelisa Hicks
(74) *Attorney, Agent, or Firm* — Chi IP Law Firm

(57) ABSTRACT

A faucet includes a faucet body, a bent tube mounted on the faucet body, a water outlet pipe retractably mounted in the bent tube and having a connector, an elastic sleeve mounted in the distal end of the bent tube, a first magnetic member mounted in the elastic sleeve, a locking sleeve mounted on the connector of the water outlet pipe and inserted into the elastic sleeve, a second magnetic member mounted in the locking sleeve and movable to approach the first magnetic member, and a spout locked onto the locking sleeve. Thus, when the locking sleeve is inserted into the elastic sleeve, the second magnetic member is attracted magnetically by the first magnetic member so as to position the locking sleeve in the elastic sleeve and to position the spout onto the distal end of the bent tube.

18 Claims, 5 Drawing Sheets

FAUCET WITH RETRACTABLE SPOUT THAT CAN BE POSITIONED QUICKLY AND AUTOMATICALLY

BACKGROUND OF THE INVENTION

1. Field of the Invention

The present invention relates to a water output device and, more particularly, to a water faucet for spraying water outward.

2. Description of the Related Art

A conventional faucet comprises a faucet body, a water inlet pipe connected with the faucet body, a spout assembly mounted on the faucet body, and a control lever mounted on the faucet body. Thus, by control of the control lever, the water from the water inlet pipe is delivered through the faucet body to the spout assembly and is injected outward from the spout assembly for use with a user. However, the spout assembly is fixed on the faucet body so that the spout assembly cannot be moved freely to satisfy the user requirement, thereby causing inconvenience to the user when operating the faucet.

BRIEF SUMMARY OF THE INVENTION

In accordance with the present invention, there is provided a faucet, comprising a faucet body, a bent tube mounted on the faucet body, a flexible water outlet pipe retractably mounted in the bent tube and having a distal end provided with a connector protruding outwardly from a distal end of the bent tube, an elastic sleeve mounted in the distal end of the bent tube, a first magnetic member mounted in the elastic sleeve, a locking sleeve mounted on the connector of the water outlet pipe and detachably inserted into the elastic sleeve, a second magnetic member mounted in the locking sleeve to move in concert with the locking sleeve and movable to approach the first magnetic member so that the second magnetic member is attracted magnetically by the first magnetic member to attach the locking sleeve to the elastic sleeve, and a spout locked onto the locking sleeve and having an inner portion formed with a water inlet port connected to the connector of the water outlet pipe to connect the spout to the water outlet pipe.

The primary objective of the present invention is to provide a faucet with a retractable spout that can be positioned quickly and automatically.

According to the primary advantage of the present invention, when the locking sleeve is inserted into the receiving space of the elastic sleeve, the second magnetic member is attracted magnetically by the first magnetic member so as to position the locking sleeve in the receiving space of the elastic sleeve and to position the spout onto the distal end of the bent tube so that the spout is positioned onto the distal end of the bent tube automatically.

According to another advantage of the present invention, the second magnetic member is attracted magnetically by the first magnetic member, and the boss of the spout is inserted into the depression of the protrusion so that the spout is positioned onto the distal end of the bent tube solidly and stably without producing a gap between the spout and the distal end of the bent tube to prevent the spout from being vibrated or swayed during a normal operation.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
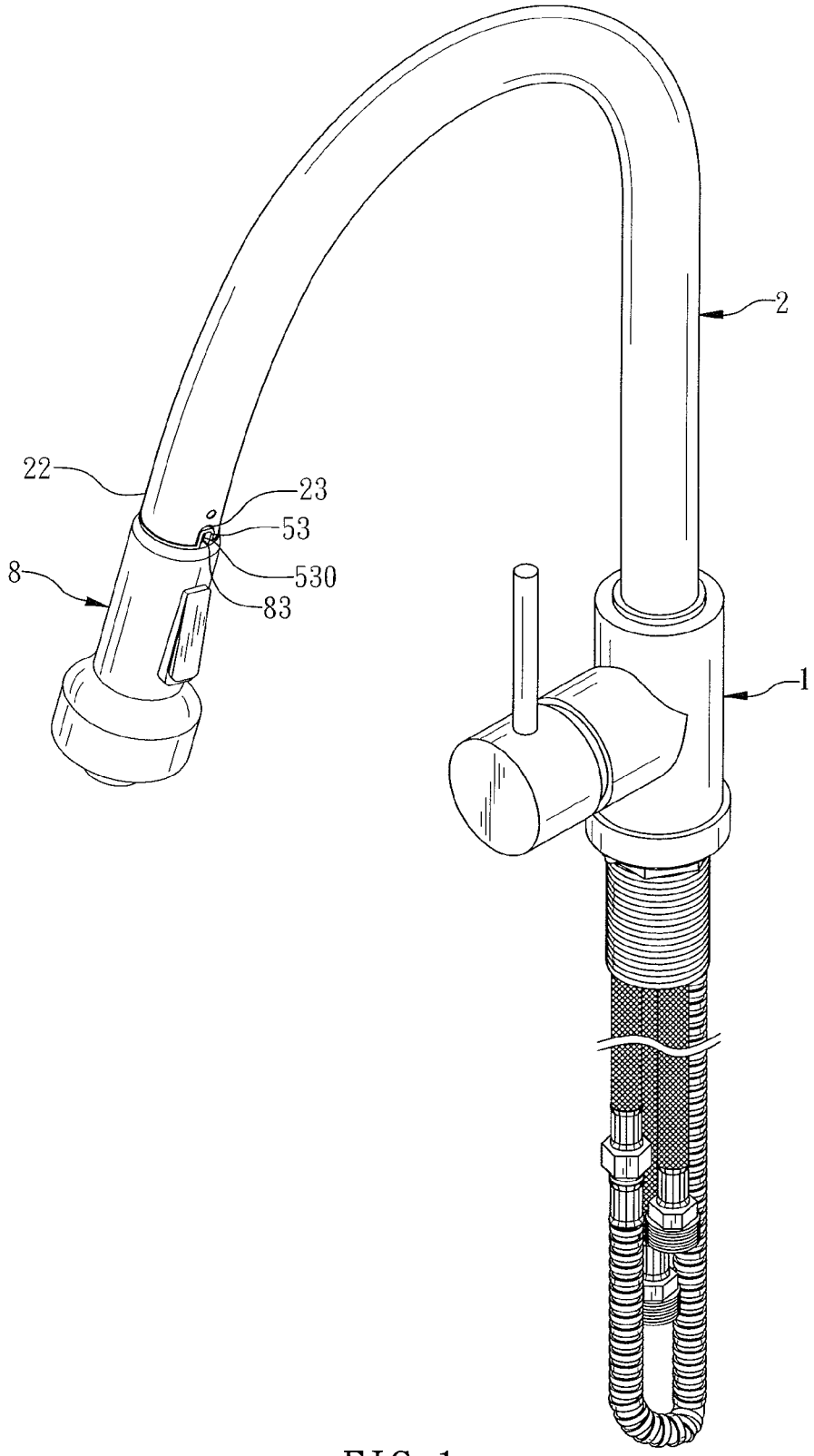
FIG. 1 is a perspective view of a faucet in accordance with the preferred embodiment of the present invention.
Figure 2:
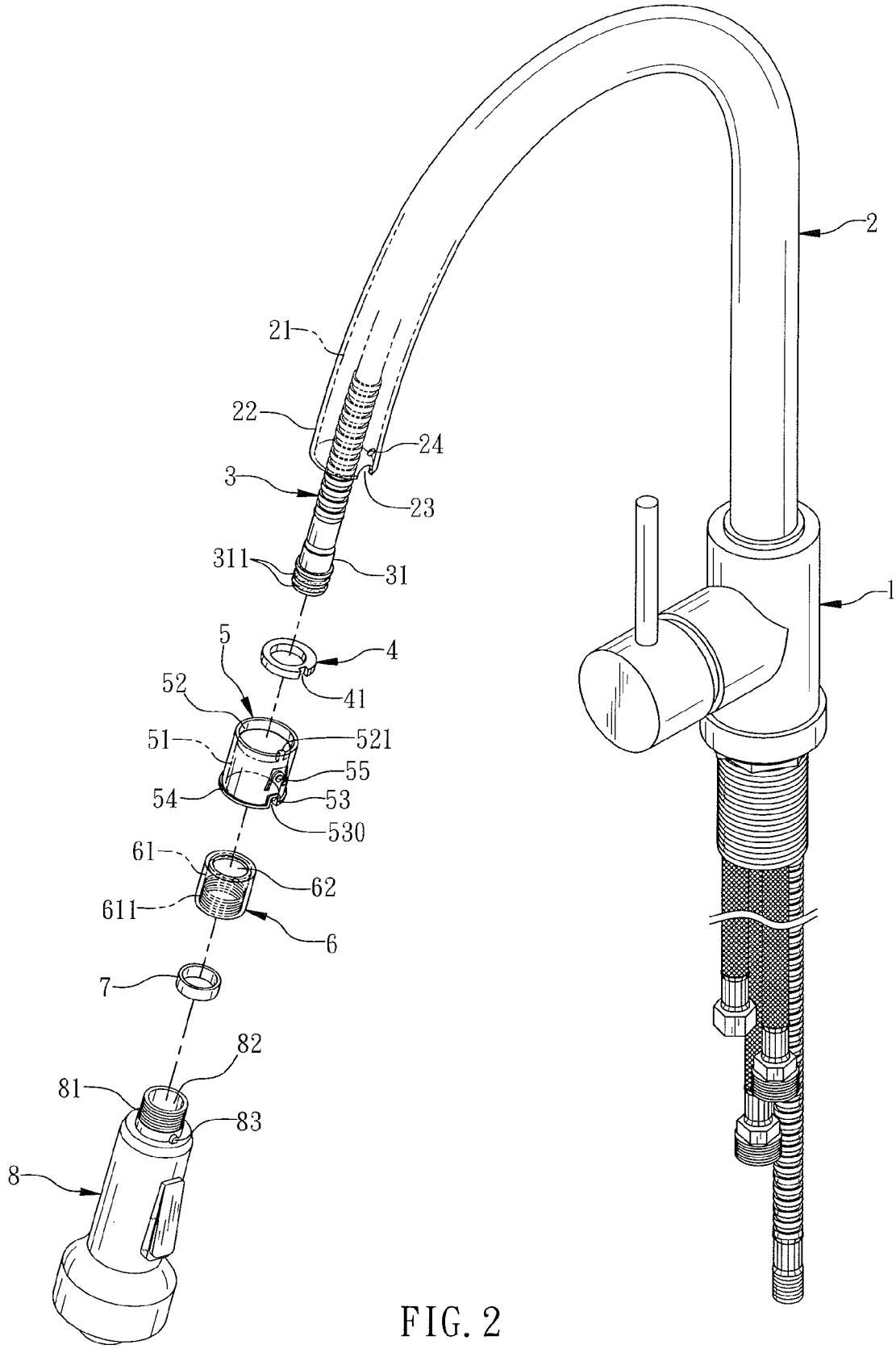
FIG. 2 is an exploded perspective view of the faucet as shown in FIG. 1.
Figure 3:
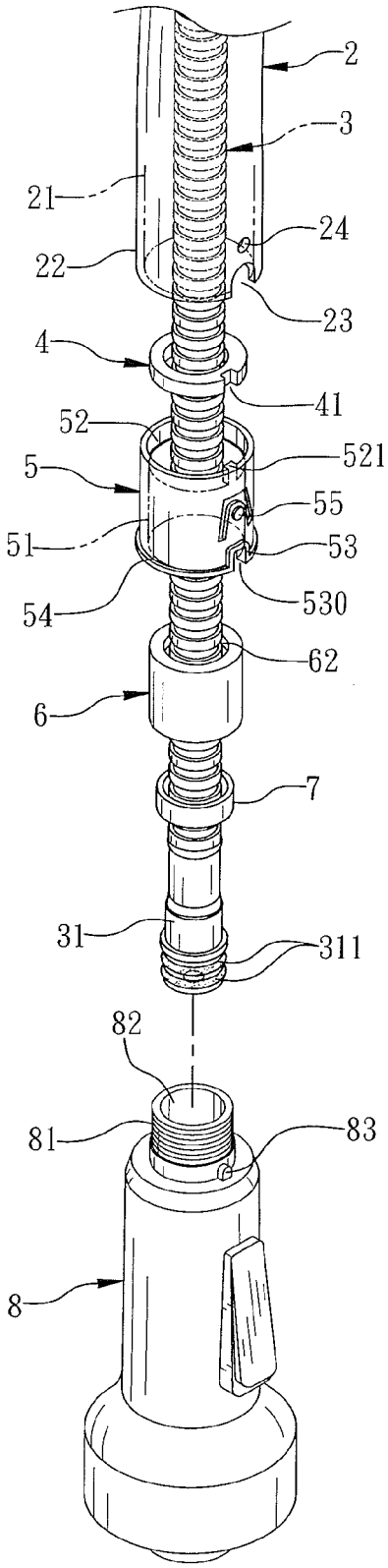
FIG. 3 is a partially exploded perspective view of the faucet as shown in FIG. 1.

Referring to the drawings and initially to FIGS. 1-4, a faucet in accordance with the preferred embodiment of the present invention comprises a faucet body 1, a bent tube 2 mounted on the faucet body 1, a flexible water outlet pipe 3 retractably mounted in the bent tube 2 and having a distal end provided with a connector 31 protruding outwardly from a distal end 22 of the bent tube 2, an elastic sleeve 5 mounted in the distal end 22 of the bent tube 2, a first magnetic member 4 mounted in the elastic sleeve 5, a locking sleeve 6 mounted on the connector 31 of the water outlet pipe 3 and detachably inserted into the elastic sleeve 5, a second magnetic member 7 mounted in the locking sleeve 6 to move in concert with the locking sleeve 6 and movable to approach the first magnetic member 4 so that the second magnetic member 7 is attracted magnetically by the first magnetic member 4 to attach the locking sleeve 6 to the elastic sleeve 5, and a spout 8 locked onto the locking sleeve 6 and having an inner portion formed with a water inlet port 82 connected to the connector 31 of the water outlet pipe 3 to connect the spout 8 to the water outlet pipe 3.

The bent tube 2 has a curved shape and has an inner portion formed with a receiving chamber 21 to receive the water outlet pipe 3.

The elastic sleeve 5 is mounted in the receiving chamber 21 of the bent tube 2 and is attached to the distal end 22 of the bent tube 2. The elastic sleeve 5 has an inner portion formed with a receiving space 51 to receive the locking sleeve 6 and to allow passage of the water outlet pipe 3. The receiving space 51 of the elastic sleeve 5 has a peripheral wall provided with a stepped stop shoulder 52 to stop the first magnetic member 4. The stop shoulder 52 of the elastic sleeve 5 has a side provided with a locking lug 521.

The first magnetic member 4 is secured in the receiving space 51 of the elastic sleeve 5 and abuts the stop shoulder 52 of the elastic sleeve 5. The first magnetic member 4 has an annular shape and has an outer wall formed with a locking recess 41 locked onto the locking lug 521 of the stop shoulder 52 to lock the first magnetic member 4 in the receiving space 51 of the elastic sleeve 5.

The locking sleeve 6 is detachably inserted into the receiving space 51 of the elastic sleeve 5 and has an inner portion formed with a mounting chamber 61 mounted on the connector 31 of the water outlet pipe 3. The mounting chamber 61 of the locking sleeve 6 has a peripheral wall provided with an inner thread 611. The locking sleeve 6 has a top formed with a reduced through hole 62 to allow passage of the connector 31 of the water outlet pipe 3. The through hole 62 of the locking sleeve 6 is connected to and has a diameter smaller than that of the mounting chamber 61.

The second magnetic member 7 is received in the mounting chamber 61 of the locking sleeve 6 and is sandwiched between the locking sleeve 6 and the connector 31 of the water outlet pipe 3. The second magnetic member 7 has an annular shape and has an outer diameter greater than the diameter of the through hole 62 of the locking sleeve 6.

The spout 8 has a top provided with an outer thread 81 screwed into the inner thread 611 of the locking sleeve 6. The outer thread 81 of the spout 8 is received in the mounting chamber 61 of the locking sleeve 6.

The water outlet pipe 3 is movable in the receiving chamber 21 of the bent tube 2. The connector 31 of the water outlet pipe 3 is movable to protrude outwardly from the receiving chamber 21 of the bent tube 2 and has an outer periphery provided with a plurality of sealing rings 311. The connector 31 of the water outlet pipe 3 in turn extends through the first magnetic member 4, the receiving space 51 of the elastic sleeve 5, the mounting chamber 61 of the locking sleeve 6 and the second magnetic member 7 and is inserted into the water inlet port 82 of the spout 8. The sealing rings 311 of the water outlet pipe 3 presses a peripheral wall of the water inlet port 82 of the spout 8 to provide an air-tight effect between the water outlet pipe 3 and the spout 8.

In the preferred embodiment of the present invention, the distal end 22 of the bent tube 2 has an open end portion formed with an opening 23 and has a surface formed with a locking hole 24. The elastic sleeve 5 has a periphery provided with a protrusion 53 inserted into the opening 23 of the bent tube 2. The protrusion 53 of the elastic sleeve 5 has a bottom formed with a depression 530. The elastic sleeve 5 has an outer wall provided with an annular stop flange 54 protruding from the receiving chamber 21 of the bent tube 2 and abutting the distal end 22 of the bent tube 2. The elastic sleeve 5 has a surface provided with a flexible locking stub 55 locked in the locking hole 24 of the bent tube 2. The spout 8 has a periphery provided with a boss 83 inserted into the depression 530 of the protrusion 53.

In the preferred embodiment of the present invention, the north pole (N) of the first magnetic member 4 faces and aligns with the south pole (S) of the second magnetic member 7 so that the second magnetic member 7 is attracted magnetically by the first magnetic member 4. In addition, the south pole (S) of the first magnetic member 4 faces and aligns with the north pole (N) of the second magnetic member 7 so that the second magnetic member 7 is attracted magnetically by the first magnetic member 4.

Figure 4:
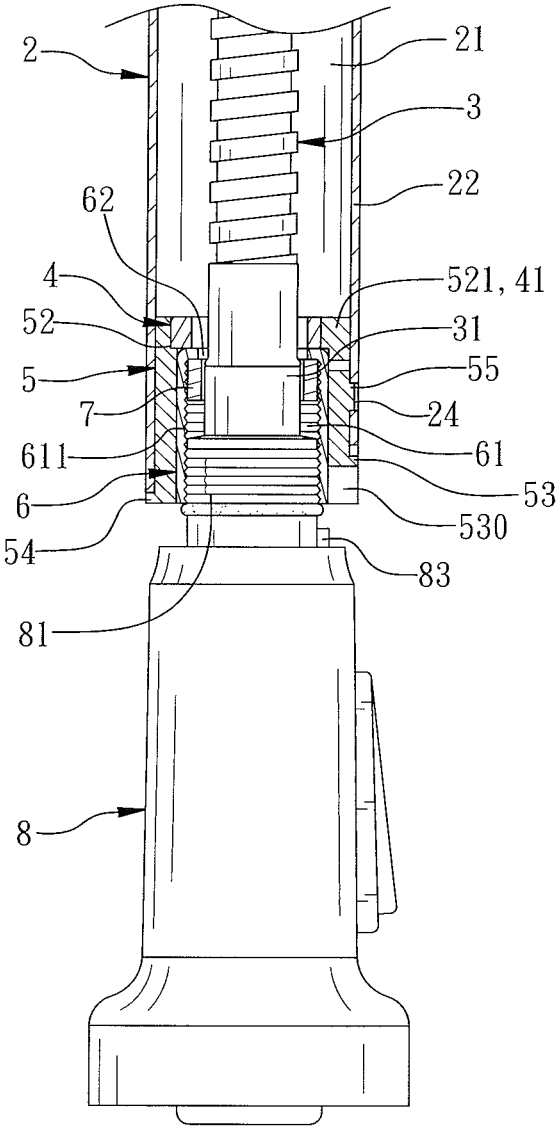
FIG. 4 is a partially front cross-sectional view of the faucet as shown in FIG. 1.
Figure 5:
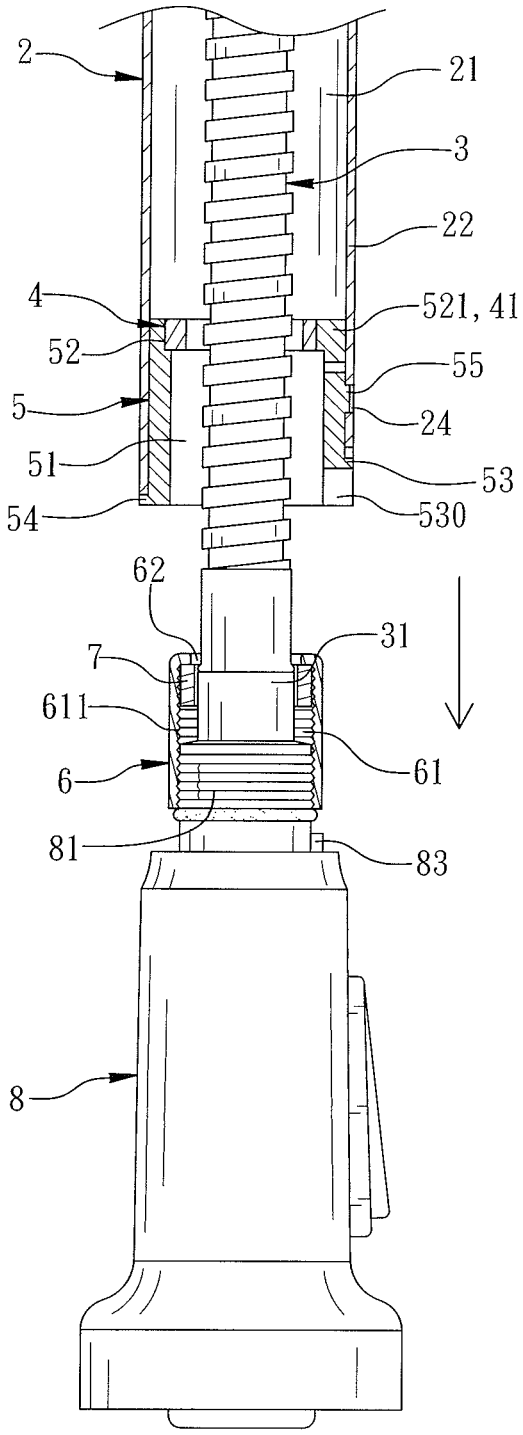
FIG. 5 is a schematic operational view of the faucet as shown in FIG. 4.

In operation, referring to FIG. 5 with reference to FIGS. 1-4, the locking sleeve 6 is initially inserted into the receiving space 51 of the elastic sleeve 5 as shown in FIG. 4 to attach the spout 8 to the distal end 22 of the bent tube 2 as shown in FIG. 1. At this time, the second magnetic member 7 is attracted magnetically by the first magnetic member 4 to provide a first positioning function so as to position the locking sleeve 6 in the receiving space 51 of the elastic sleeve 5 and to position the spout 8 onto the distal end 22 of the bent tube 2 at a first stage. In addition, the boss 83 of the spout 8 is inserted into the depression 530 of the protrusion 53 to provide a second positioning function so as to position the spout 8 onto the distal end 22 of the bent tube 2 at a second stage.

When the spout 8 is pulled outward relative to the bent tube 2, the locking sleeve 6 is detached from the receiving space 51 of the elastic sleeve 5 as shown in FIG. 5, and the water outlet pipe 3 is extended outward from the distal end 22 of the bent tube 2 so that the spout 8 is removed from the distal end 22 of the bent tube 2 for use with a user.

When the spout 8 is not in use, the spout 8 is pulled toward the bent tube 2 so that the locking sleeve 6 is inserted into the receiving space 51 of the elastic sleeve 5, and the water outlet pipe 3 is retracted into the receiving chamber 21 of the bent tube 2 as shown in FIG. 4 to attach the spout 8 to the distal end 22 of the bent tube 2 as shown in FIG. 1. At this time, the second magnetic member 7 is attracted magnetically by the first magnetic member 4 so as to position the locking sleeve 6 in the receiving space 51 of the elastic sleeve 5 and to position the spout 8 onto the distal end 22 of the bent tube 2 automatically.

Accordingly, when the locking sleeve 6 is inserted into the receiving space 51 of the elastic sleeve 5, the second magnetic member 7 is attracted magnetically by the first magnetic member 4 so as to position the locking sleeve 6 in the receiving space 51 of the elastic sleeve 5 and to position the spout 8 onto the distal end 22 of the bent tube 2 so that the spout 8 is positioned onto the distal end 22 of the bent tube 2 automatically. In addition, the second magnetic member 7 is attracted magnetically by the first magnetic member 4, and the boss 83 of the spout 8 is inserted into the depression 530 of the protrusion 53 so that the spout 8 is positioned onto the distal end 22 of the bent tube 2 solidly and stably without producing a gap between the spout 8 and the distal end 22 of the bent tube 2 to prevent the spout 8 from being vibrated or swayed during a normal operation.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A faucet, comprising:

a faucet body;

a bent tube mounted on the faucet body;

a flexible water outlet pipe retractably mounted in the bent tube and having a distal end provided with a connector protruding outwardly from a distal end of the bent tube;

an elastic sleeve mounted in the distal end of the bent tube;

a first magnetic member mounted in the elastic sleeve;

a locking sleeve mounted on the connector of the water outlet pipe and detachably inserted into the elastic sleeve;

a second magnetic member mounted in the locking sleeve to move in concert with the locking sleeve and movable to approach the first magnetic member so that the second magnetic member is attracted magnetically by the first magnetic member to attach the locking sleeve to the elastic sleeve;

a spout locked onto the locking sleeve and having an inner portion formed with a water inlet port connected to the connector of the water outlet pipe to connect the spout to the water outlet pipe, wherein the distal end of the bent tube has an open end portion formed with an opening, wherein the elastic sleeve has a periphery provided with a protrusion inserted into the opening of the bent tube, said protrusion of the elastic sleeve having a bottom formed with a depression and said spout having a periphery provided with a boss inserted into the depression of the protrusion.

2. The faucet of claim 1, wherein:

the bent tube has an inner portion formed with a receiving chamber to receive the water outlet pipe;

the elastic sleeve has an inner portion formed with a receiving space to receive the locking sleeve and to allow passage of the water outlet pipe;

the receiving space of the elastic sleeve has a peripheral wall provided with a stepped stop shoulder to stop the first magnetic member;

the stop shoulder of the elastic sleeve has a side provided with a locking lug;

the first magnetic member is secured in the receiving space of the elastic sleeve and abuts the stop shoulder of the elastic sleeve;

the first magnetic member has an outer wall formed with a locking recess locked onto the locking lug of the stop shoulder to lock the first magnetic member in the receiving space of the elastic sleeve;

the locking sleeve has an inner portion formed with a mounting chamber mounted on the connector of the water outlet pipe;

the mounting chamber of the locking sleeve has a peripheral wall provided with an inner thread;

the second magnetic member is received in the mounting chamber of the locking sleeve and is sandwiched between the locking sleeve and the connector of the water outlet pipe; and the spout has a top provided with an outer thread screwed into the inner thread of the locking sleeve.

3. The faucet of claim 2, wherein:

the locking sleeve has a top formed with a reduced through hole to allow passage of the connector of the water outlet pipe;

the through hole of the locking sleeve is connected to and has a diameter smaller than that of the mounting chamber; and the second magnetic member has an outer diameter greater than the diameter of the through hole of the locking sleeve.

4. The faucet of claim 2, wherein the connector of the water outlet pipe in turn extends through the first magnetic member, the receiving space of the elastic sleeve, the mounting chamber of the locking sleeve and the second magnetic member.

5. The faucet of claim 2, wherein the elastic sleeve has an outer wall provided with an annular stop flange protruding from the receiving chamber of the bent tube and abutting the distal end of the bent tube.

6. The faucet of claim 2, wherein the locking sleeve is detachably inserted into the receiving space of the elastic sleeve.

7. The faucet of claim 2, wherein the elastic sleeve is mounted in the receiving chamber of the bent tube and is attached to the distal end of the bent tube.

8. The faucet of claim 2, wherein the outer thread of the spout is received in the mounting chamber of the locking sleeve.

9. The faucet of claim 2, wherein the water outlet pipe is movable in the receiving chamber of the bent tube.

10. The faucet of claim 2, wherein the connector of the water outlet pipe is movable to protrude outwardly from the receiving chamber of the bent tube.

11. The faucet of claim 1, wherein the connector of the water outlet pipe is inserted into the water inlet port of the spout.

12. The faucet of claim 11, wherein the connector of the water outlet pipe has an outer periphery provided with a plurality of sealing rings, and the sealing rings of the water outlet pipe presses a peripheral wall of the water inlet port of the spout to provide an air-tight effect between the water outlet pipe and the spout.

13. The faucet of claim 1, wherein the distal end of the bent tube has a surface formed with a locking hole, and the elastic sleeve has a surface provided with a flexible locking stub locked in the locking hole of the bent tube.

14. The faucet of claim 1, wherein the north pole (N) of the first magnetic member faces and aligns with the south pole (S) of the second magnetic member so that the second magnetic member is attracted magnetically by the first magnetic member.

15. The faucet of claim 1, wherein the south pole (S) of the first magnetic member faces and aligns with the north pole (N) of the second magnetic member so that the second magnetic member is attracted magnetically by the first magnetic member.

16. The faucet of claim 1, wherein the bent tube has a curved shape.

17. The faucet of claim 1, wherein the first magnetic member has an annular shape.

18. The faucet of claim 1, wherein the second magnetic member has an annular shape.

* * * * *